US005709986A

United States Patent [19]

Smith et al.

[11] Patent Number: 5,709,986

[45] Date of Patent: Jan. 20, 1998

[54] PHOTOGRAPHIC ELEMENTS EMPLOYING POLYMERIC PARTICLES

[75] Inventors: Dennis Edward Smith; John Leonard Muehlbauer, both of Rochester; Yongcai Wang, Penfield, all of N.Y.

[73] Assignee: Eastman Kodak Company, Rochester, N.Y.

[21] Appl. No.: 594,102

[22] Filed: Jan. 30, 1996

[51] Int. Cl.[6] ..... G03C 1/76

[52] U.S. Cl. ..... 430/531; 430/523; 430/536; 430/961; 430/537; 430/631; 430/950

[58] Field of Search ..... 430/523, 531, 430/536, 537, 631, 950, 961

[56] References Cited

U.S. PATENT DOCUMENTS

| | | | |
|---|---|---|---|
| 3,085,981 | 4/1963 | Tanenbaum | 252/62.5 |
| 4,142,894 | 3/1979 | Hori et al. | 430/950 |
| 4,363,871 | 12/1982 | Shibue et al. | 430/523 |
| 4,447,525 | 5/1984 | Vallarino et al. | 430/523 |
| 4,614,708 | 9/1986 | Timmerman et al. | 430/517 |
| 4,990,434 | 2/1991 | Van Thillo et al. | 430/510 |
| 4,992,357 | 2/1991 | Haga et al. | 430/537 |
| 5,061,766 | 10/1991 | Yamashita et al. | 526/191 |
| 5,279,934 | 1/1994 | Smith et al. | 430/950 |
| 5,362,602 | 11/1994 | Coppens et al. | 430/262 |
| 5,370,982 | 12/1994 | Tashiro et al. | 430/536 |
| 5,378,577 | 1/1995 | Smith et al. | 430/961 |
| 5,550,011 | 8/1996 | Fant et al. | 430/523 |
| 5,595,862 | 1/1997 | Fant et al. | 430/537 |

FOREIGN PATENT DOCUMENTS

| | | |
|---|---|---|
| 0 620 481 A3 | 10/1994 | European Pat. Off. . |
| 61/215-603-A | 3/1985 | Japan . |

*Primary Examiner*—Geraldine Letscher
*Attorney, Agent, or Firm*—Carl F. Ruoff; Robert A. Gerlach

[57] ABSTRACT

A photographic element having a support, at least one light-sensitive silver halide layer and a layer containing matte bead particles, the matte bead particles being a copolymer of a styrenic monomer or acrylic acid or methacrylic acid or an acrylic acid ester or a methacrylic acid ester or mixture thereof where the ester group contains up to 6 carbon atoms and an acrylic or methacrylic acid ester where the ester group has from 10 to 22 carbon atoms, each matte bead particle being surrounded by colloidal size particles of a suspension stabilizing agent.

7 Claims, No Drawings

PHOTOGRAPHIC ELEMENTS EMPLOYING POLYMERIC PARTICLES

FIELD OF THE INVENTION

This invention relates to polymeric particles, a method of making such particles and to photographic elements employing the same. More particularly, it relates to uniformly-sized polymeric particles, having a very low population of oversized particles.

BACKGROUND OF THE INVENTION

It is known that particles can be made by a variety of *in situ* polymerization techniques such as suspension polymerization or limited coalescence (LC) polymerization, as well as other methods, such as, crushing or grinding of solid polymer samples, spray drying, evaporation of solvent from a dispersion of a polymer solution, etc. In order to obtain a narrow particle size distribution of useful product, all of these techniques require extensive sorting and classification operations that are costly, time-consuming and cause substantial reductions in yield. LC polymerization frequently provides nearly monodisperse particle size distributions. However, even with LC polymerization, the particle size distribution of polymer particles is not ideal. In particular, it is commonly observed that a substantial population of oversized particles is formed. Further, particularly when larger particles are being made, an appreciable amount of coagulum results. The presence of these materials introduces the necessity for complex processing steps in manufacturing such as, filtration, sieving, cyclone separation and the like.

LC polymerization is a term referring to a specific kind of suspension polymerization process. "Suspension polymerization" refers to a process in which a polymerizable liquid is dispersed as droplets in a continuous aqueous medium and polymerized under continuous vigorous agitation.

Normally, this process is carried out in the presence of a "granulating agent", such as a lyophilic polymer (starch, natural gums, polyvinyl alcohol or the like) or an insoluble fine powder such as calcium phosphate. These granulating agents help to obtain a dispersion of droplets of the polymerizable liquid but do not provide sufficient stabilization of the dispersion so that the dispersed droplets are stable in the absence of agitation. Therefore, in this method, it is necessary to carry out the polymerization under continuous vigorous mechanical agitation, since otherwise extensive coalescence of the droplets will occur, with separation of a bulk phase of the water immiscible, polymerizable material. Because this process depends on the details of the shear field in the reactor, and on the changing viscosity of the polymerizing dispersed phase, it is difficult to control reproducibly, is not readily scaleable, and gives a broad particle size distribution (PSD). In addition, conditions for one dispersed phase are not generalizable to other dispersed phases.

"Limited coalescence polymerization" also refers to a process in which the water-immiscible polymerizable liquid is dispersed in an aqueous medium. In distinction to the suspension polymerization method, however, the dispersion process is carried out in the presence of a colloidal water-insoluble particulate stabilizer which is capable of providing good stability to the dispersed droplets. In the presence of such a stabilizer, the droplets are stable once formed, even in the absence of mechanical agitation. The polymerization can therefore be carried out with no or minimal stirring (only enough to prevent creaming or sedimentation and provide good thermal transfer). Various stabilizing colloids are well-known in the art (for example, clays, colloidal silica, and latex particles, as described, for example, in U.S. Pat. Nos. 5,133,912; 4,965,131 and 2,932,629). This process has also been referred to as "quiescent suspension polymerization". It has substantial advantages over normal suspension polymerization, in that it gives reproducible behavior, relatively narrow PSD's which are a function principally of the amount of particulate colloidal stabilizer used (and not a function of the mechanical agitation), is readily scaleable, and allows high productivity because large concentrations of polymerizable materials can be suspended in the aqueous medium.

PROBLEM TO BE SOLVED BY THE INVENTION

The PSD of particles obtained by LC polymerization is, however, still not ideal. In particular, there are typically particles larger than desired, which result in defects, such as, starry night, pinholes and/or image granularity when the particles are included in layers of photographic elements. Further, the presence of larger particles cause manufacturing problems such as plugging of filters used as a unit operation in the coating of photographic layers.

Thus, it can be readily seen that there is a need for polymeric particles that are uniformly sized and have reduced populations of oversized particles, for a method of preparation and for photographic elements having at least one layer containing such uniformly sized particles.

SUMMARY OF THE INVENTION

The invention provides uniformly sized polymeric particles by a process including forming a droplet of ethylenically unsaturated monomer surrounded by particulate suspension stabilizing agent in an aqueous medium and polymerizing the ethylenically unsaturated monomer, the improvement comprising employing as the ethylenically unsaturated monomer a mixture of a styrenic monomer or an acrylic or methacrylic acid or esters thereof where the ester group contains up to 6 carbon atoms and an acrylic or methacrylic acid ester, the ester group having from 10 to 22 carbon atoms.

Another aspect of the invention is to provide polymeric particles of a copolymer of a styrenic monomer or an acrylic or methacrylic acid or esters thereof where the ester group contains up to 6 carbon atoms and an acrylic or methacrylic acid ester, the ester group having from 10 to 22 carbon atoms the particles being surrounded by colloidal size particles of a suspension stabilizing agent.

A further aspect of this invention is to provide a photographic element having a support, at least one light sensitive layer and a layer containing matte bead polymeric particles of a copolymer of a styrenic monomer or an acrylic or methacrylic acid or esters thereof where the ester group contains up to 6 carbon atoms and an acrylic or methacrylic acid ester, the ester group having from 10 to 22 carbon atoms the particles being surrounded by colloidal size particles of a suspension stabilizing agent. The polymer particles for use in a photographic element have a mean size of from 0.3 to 10 μm, preferably from 0.5 to 5 μm.

ADVANTAGEOUS EFFECT OF THE INVENTION

The particles and the method of making are particularly suitable where uniform size and size distribution are a consideration such as photographic matte beads, electrophotographic toner particles, thermal print spacer beads, polymeric microvoiding agents, grinding media, spreading layers, particle size standards, filter challenge media, ion-exchange resin packing media, Merrifield synthesis supports, etc., because the particles thus formed unexpectedly have more uniform particle size and contain reduced populations of oversized particles. These particles have a mean particle size of from 0.3 to 500 μm, preferably from 0.5 to 100 μm.

Also, the invention contemplates a mixture of a styrenic monomer, an acrylic or methacrylic acid or esters thereof where the ester group contains 6 carbon atoms or less and an acrylic or methacrylic acid ester, the ester group having from 10 to 22 carbon atoms, the latter compound being in an amount of 0.1 to 20 percent by weight.

DETAILED DESCRIPTION OF THE INVENTION

The invention contemplates a method of making uniformly sized polymeric particles in a limited coalescence polymerization process where the reactants include a styrenic monomer or an acrylic monomer selected from acrylic acid, methacrylic acid, acrylic acid esters and methacrylic acid esters where the ester groups contain up to 6 carbon atoms and an acrylic acid or methacrylic acid ester where the ester group contains 10 to 22 carbon atoms, preferably 12 to 20 carbon atoms and most preferably 15 to 18 carbon atoms. In the formulation of monomers, the acrylic monomer having 10 to 22 carbon atoms should be present in an amount of from 0.1 to 20 percent by weight, preferably from 0.5 to 10 percent by weight and most preferably 1 to 5 percent by weight.

In limited coalescence polymerization, generally, an ethylenically unsaturated monomer or mixture of monomers together with a free radical initiator are subject to high shear with an aqueous medium containing a colloidal water-insoluble particulate suspension stabilizer, a promoter and a free radical scavenger. When high shearing is stopped and equilibrium is reached, i.e., the size stabilized by limited coalescence, the suspension is heated to cause the polymerization of the monomer droplets.

Suitable ethylenically unsaturated styrenic monomers or mixtures of styrenic monomers include vinyl substituted aromatic compounds, such as styrene, methylstyrene, dimethylstyrene, trimethylstyrene, isopropylstyrene, trifluoromethylstyrene, ethoxymethylstyrene, methoxystyrene, vinyl toluene, p-chlorostyrene, 2-chloromethylstyrene, dichlorostyrene, bromostyrene, fluorostyrene, vinylbenzene, ethyl vinylbenzene, 4-t-butylstyrene, or vinyl naphthalene and the like.

Acrylic acid and methacrylic acid or their mixtures are suitable as are their esters or mixtures thereof where the ester group contains 6 carbon atoms or less. Suitable acrylic and methacrylic acid esters include methyl acrylate, ethyl acrylate, n-butyl acrylate, t-butyl acrylate, isopropyl acrylate, amyl acrylate, hexyl acrylate, cyclohexyl acrylate, cyanoethyl acrylate, chloroethyl acrylate, bromoethyl acrylate, phenyl acrylate, methyl-α-chloroacrylate, chlorobutyl acrylate, diethylaminoethyl acrylate, 2-hydroxyethyl acrylate, 3-hydroxypropyl acrylate, 2-hydroxypropyl acrylate, 4-hydroxybutyl acrylate, 5-hydroxypentyl acrylate, 2,2-dimethyl-3-hydroxypropyl acrylate, methyl methacrylate, ethyl methacrylate, n-butyl methacrylate, t-butyl methacrylate, isopropyl methacrylate, amyl methacrylate, hexyl methacrylate, cyclohexyl methacrylate, cyanoethyl methacrylate, chloroethyl methacrylate, bromoethyl methacrylate, phenyl methacrylate, methyl-α-chloromethacrylate, chlorobutyl methacrylate, diethylaminoethyl methacrylate, 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate and the like.

If desired, a suitable crosslinking monomer may be used in forming polymer particles in accordance with this invention to thereby modify the polymeric particle and produce particularly desired properties. Typical crosslinking monomers are aromatic divinyl compounds such as divinylbenzene, divinylnaphthalene or derivatives thereof; diethylene glycol diacrylates and dimethacrylates and other divinyl compounds such as divinyl sulfide, divinyl ether or divinyl sulfone compounds.

Suitable acrylic or methacrylic acid esters where the ester group contains 10 to 22 carbon atoms include lauryl methacrylate, stearyl methacrylate, isodecyl acrylate, isodecyl methacrylate, n-decyl acrylate, n-decyl methacrylate, isobornyl acrylate, isobornyl methacrylate, triphenylmethyl methacrylate, dodecyl methacrylate, tridecyl methacrylate, lauryl acrylate, naphtyl methacrylate, octadecyl acrylate, octadecyl methacrylate, docosyl methacrylate. Preferred monomers are lauryl methacrylate and stearyl methacrylate.

Any catalyst or initiator which is soluble in the particular monomer or monomers polymerized within the droplets may be utilized in the process of the invention. Typical initiators for polymerization are the peroxide and azo initiators. Among those found suitable for use in the process of the invention are 2,2' azobis (2,4-dimethyl valeronitrile), lauroyl peroxide, benzoyl peroxide, Perkadox AMBN (a product sold by Akzo Chemical) and the like which result in complete polymerization without leaving detrimental residual materials. Chain transfer agents may also be added to the monomer to control the properties of the polymer particles formed.

The diameter of the monomer droplets, and hence the diameter of the polymer particles (average particle size), can be varied predictably in limited coalescence methods. This is accomplished by deliberate variation of the composition of the aqueous liquid dispersion to control the average particle size of the polymer particles, in particular the amount of particulate suspension stabilizer.

The particulate suspension stabilizers employed in the practice of this invention include any of the solid colloidal materials that are known in prior art to be suitable for this purpose. Such stabilizers provide a third phase because they are insoluble in both the aqueous suspension medium and in the suspended droplets. They are also nondispersible in the droplets, but wettable or can be made to be wettable by the droplets. They are more hydrophilic than oleophilic, and more hydrophilic than the droplets, so that they can remain at the interface of the aqueous suspension medium and the suspended droplets. Such stabilizers can be inorganic materials such as insoluble metal salts or hydroxides or oxides or clays or can be organic materials such as starches, sulfonated crosslinked organic polymers and resinous polymers, as described, for example, in U.S. Pat. No. 2,932,629. Silica, as described in U.S. Pat. Nos. 4,833,060 and 5,378,577, and copolymers such as copoly(styrene-2-hydroxyethyl methacrylate-methyacrylic acid-ethylene glycol dimethacrylate), as described in U.S. Pat. No. 4,965,131, are examples of particularly desirable particulate suspension stabilizers that can be used in the practice of this invention.

It is known that some suspension stabilizers, for example silica, are used with promoters that are present in the aqueous suspension medium and drive the particulate suspension stabilizer to the interface between the aqueous phase and the monomer droplets formed. When a promoter is used in the method of this invention, any suitable promoter that affects the hydrophilic/hydrophobic balance of the particulate suspension stabilizer in the aqueous suspension medium may be employed to drive the solid particulate suspension stabilizer particles to the interface. Suitable materials include, for example, sulfonated polystyrenes, alginates, carboxymethyl cellulose, various alkyl or polyalkyl ammonium salts, polydiethylaminoethylmethacrylate, water-soluble complex resinous amine condensation products such as water-soluble condensation products of ethylene oxide, urea and formaldehyde, polyethyleneimine and the water soluble condensation products of diethanol amine and adipic acid. A particularly suitable promoter of this type is poly (adipic acid-co-methylaminoethanol). Also effective as promoters are gelatin, glue, casein, albumin and gluten. Nonionic materials such as methoxy cellulose can be used.

It is sometimes desirable to add to the aqueous suspension a few parts per million of a water-soluble, oil-insoluble polymerization inhibitor, also referred to as a free radical scavenger which is effective to prevent the polymerization of monomer molecules that may diffuse into the aqueous suspension medium. Suitable inhibitors are well-known in the prior art as exemplified by U.S. Pat. Nos. 2,932,629 and 4,994,312. Suitable polymerization inhibitors include, for example, potassium dichromate and cupric sulfate pentahydrate.

The polymeric particles of this invention may be included in any layer of a photographic element, however, it is preferred to incorporate the particles in a protective overcoat layer.

Any suitable hydrophilic binder can be used in a protective overcoat layer in the practice of this invention, such as naturally occurring substances such as proteins, protein derivatives, cellulose derivatives (e.g., cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

Gelatin can be used together with other water dispersible polymers as binders in the practice of the present invention. The water dispersible polymers can be incorporated into either light sensitive or light-insensitive layers. Suitable water dispersible polymers include both synthetic and natural water dispersible polymers. Synthetic water dispersible polymers may contain a nonionic group, an anionic group, or a nonionic group and an anionic group in the molecular structure. The nonionic group may be, for example, an ether group, an ethylene oxide group, an amide group, or a hydroxyl group. The anionic group may be, for example, a sulfonic acid group or the salt thereof, a carboxylic acid group or the salt thereof, or a phosphoric acid group or the salt thereof. The natural water soluble polymer may include a nonionic group, an anionic group, or a nonionic group and an anionic group in the molecular structure. The water dispersible polymers may be incorporated into the photographic materials of the present invention in an amount of preferably at least 0.5 percent, preferably from 1 to 50 percent, and most preferably from 2 to 30 percent based on the amount of the whole coated amount of gelatin on the side having a layer containing the matte particle of the present invention.

Water dispersible polymers useful for the present invention include vinyl polymer latex particles prepared by an emulsion polymerization process, water-borne polyurethane dispersions, water-borne epoxy dispersions, water-borne polyester dispersions, and the like. The mean size of the dispersed particles is within the range of from 0.01 to 0.2 μm, preferably from 0.02 to 0.1 μm.

The binder should be chosen so that it effectively adheres the matte particles to the surface of the element. For a crosslinkable binder such as gelatin, the binder is preferably cross-linked so as to provide a high degree of cohesion and adhesion. Crosslinking agents or hardeners which may effectively be used in the coating compositions of the present invention include aldehydes, epoxy compounds, polyfunctional aziridines, vinyl sulfones, melamines, triazines, polyisocyanates, dioxane derivatives such as dihydroxydioxane, carbodiimides, chrome alum, zirconium sulfate, and the like.

Processing removable mattes may be used together with the matte particles in the practice of the invention. Such processing removable mattes include particles of, for example, copolymers of alkyl (meth)acrylates and methacrylic acid, or acrylic acid, or itaconic acid, copolymers of alkyl (meth)acrylates and maleic monoesters or monoamides, copolymers of styrene or vinyl toluene and α,β-unsaturated mono- or di-carboxylic acids, or dicarboxylic monoesters or monoamides, graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropylomethyl cellulose. Such processing soluble mattes are described in further detail in U.S. Pat. Nos. 2,992,101; 3,767,448; 4,094,848; 4,447,525; and 4,524,131.

The protective overcoat layer useful in the practice of the invention may optionally contain surface active agents, antistatic agents, charge control agents, thickeners, ultraviolet ray absorbers, processing removable dyes, high boiling point solvents, silver halide particles, colloidal inorganic particles, magnetic recording particles, and various other additives.

The matte-containing layer useful in the practice of the invention can be applied by any of a number of well-known techniques, such as dip coating, rod coating, blade coating, air knife coating, gravure coating and reverse roll coating, extrusion coating, slide coating, curtain coating, and the like. After coating, the protective layer is generally dried by simple evaporation, which may be accelerated by known techniques such as convection heating. Known coating and drying methods are described in further detail in Research Disclosure No. 308, Published Dec. 1989, pages 1007 to 1008.

The photographic element of the present invention can contain an electrically conductive layer, which can be either a surface protective layer or a sub layer. The surface resistivity of at least one side of the support is preferably less than $1\times10^{12}\Omega$/square, more preferably less than $1\times10^{11}\Omega$/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The protective overcoat layer in accordance with this invention may be positioned over a transparent magnetic recording layer as described in U.S. Pats. 5,395,743; 5,397,826; 5,113,903; 5,432,050; 5,434,037; and 5,436,120.

The present invention is also directed to a single-use camera having incorporated therein a photographic material as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the single-use camera to the consumer does not normally occur, however, the photographic material will be returned.

The photographic processing steps to which the raw film may be subject may include, but are not limited to the following:

(1) color developing→bleach-fixing→washing/stabilizing;

(2) color developing→bleaching→fixing→washing/stabilizing;

(3) color developing→bleaching→bleach-fixing→washing/stabilizing;

(4) color developing→stopping→washing→bleaching→washing→fixing→washing/stabilizing;

(5) color developing→bleach-fixing→fixing→washing/stabilizing; , (6) color developing→bleaching→bleach-fixing→fixing→washing/stabilizing;

Among the processing steps indicated above, the steps (1), (2), (3), and (4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567;WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

Single-use cameras and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The invention is further illustrated by the following examples in which parts and percentages are by weight unless otherwise noted and particle size distributions and populations of oversized particles are measured using a Coulter Multisizer TAII.

EXAMPLE 1 (Control)

22.5 g of Perkadox AMBN (Akzo Chemical) initiator are dissolved in 1500 g of vinyltoluene. In a separate container, 2.12 kg of pH 4 buffer (prepared from 200 kg distilled water, 2092 g potassium biphthalate, and 820 ml 0.1N HCl) are mixed with 0.19 g potassium dichromate, 25.7 g MAEA (poly(N-methylaminoethanol-co-adipate)) and 367 grams of colloidal silica soldby DuPont Co. under the trade designation Ludox™. The monomer solution is combined with the aqueous solution, stirred for 10 minutes and passed through a Crepaco homogenizer operated at 5000 psi and then heated to 70° C. with slow stirring overnight.

EXAMPLE 2 (Invention)

22.5 g of Perkadox AMBN (Akzo Chemical) initiator are dissolved in a mixture of 1485 g of vinyltoluene and 15 g of stearyl methacrylate (Lubrizol 2509 from the Lubrizol Corp.). In a separate container, 2.12 kg of pH 4 buffer (prepared from 200 kg distilled water, 2092 g potassium biphthalate, and 820 ml 0.1N HCl) are mixed with 0.19 g potassium dichromate, 25.7 g MAEA (poly(N-methylaminoethanol-co-adipate)) and 367 grams of colloidal silica sold by DuPont Co. under the trade designation Ludox™. The monomer solution is combined with the aqueous solution, stirred for 10 minutes and passed through a Crepaco homogenizer operated at 5000 psi and then heated to 70° C. with slow stirring overnight.

EXAMPLE 3 (Invention)

22.5 g of Perkadox AMBN (Akzo Chemical) initiator are dissolved in a mix of 1425 g of vinyltoluene and 75 g of stearyl methacrylate (Lubrizol 2509 from the Lubrizol Corp.). In a separate container, 2.12 kg of pH 4 buffer (prepared from 200 kg distilled water, 2092 g potassium biphthalate, and 820 ml 0.1N HCl) are mixed with 0.19 g potassium dichromate, 25.7 g MAEA (poly(N-methylaminoethanol-co-adipate)) and 367 grams of colloidal silica sold by DuPont Co. under the trade designation Ludox™. The monomer solution is combined with the aqueous solution, stirred for 10 minutes and passed through a Crepaco homogenizer operated at 5000 psi and then heated to 70° C. with slow stirring overnight.

EXAMPLE 4 (Control)

15.0 g of Perkadox AMBN (Akzo Chemical) initiator are dissolved in 1,000 g of methyl acrylate. In a separate container, 3.2 kg of pH 4 buffer (prepared from 200 kg distilled water, 2092 g potassium biphthalate, and 820 ml 0.1N HCl) are mixed with 0.18 g potassium dichromate, 19.65 g MAEA (poly(N-methylaminoethanol-co-adipate)) and 267 grams of colloidal silica sold by DuPont Co. under the trade designation Ludox™. The monomer solution is combined with the aqueous solution, stirred for 10 minutes and passed through a Crepaco homogenizer operated at 5000 psi and then heated to 60° C. with 100 rpm stirring overnight. All the monomer polymerizes into a solid mass rather than polymerize into discrete bead particles.

EXAMPLE 5 (Invention)

15.0 g of Perkadox AMBN (Akzo Chemical) initiator are dissolved in 990 g of methyl acrylate and 10 10 g of stearyl methacrylate (Lubrizol 2509 from the Lubrizol Corp.). In a separate container, 3.2 kg of pH 4 buffer (prepared from 200 kg distilled water, 2092 g potassium biphthalate, and 820 ml 0.1N HCl) are mixed with 0.18 g potassium dichromate, 19.65 g MAEA (poly(N-methylaminoethanol-co-adipate)) and 267 grams of colloidal silica sold by DuPont Co. under the trade designation Ludox™. The monomer solution is combined with the aqueous solution, stirred for 10 minutes and passed through a Crepaco homogenizer operated at 5000 psi and then heated to 60° C. with 100 rpm stirring overnight.

EXAMPLE 6 (Invention)

15.0 g of Perkadox AMBN (Akzo Chemical) initiator are dissolved in 950 g of methyl acrylate and 50 g of stearyl methacrylate (Lubrizol 2509 from the Lubrizol Corp.). In a separate container, 3.2 kg of pH 4 buffer (prepared from 200 kg distilled water, 2092 g potassium biphthalate, and 820 ml 0.1N HCl) are mixed with 0.18 g potassium dichromate, 19.65 g MAEA (poly(N-methylaminoethanol-co-adipate)) and 267 grams of colloidal silica sold by DuPont Co. under the trade designation Ludox™. The monomer solution is combined with the aqueous solution, stirred for 10 minutes and passed through a Crepaco homogenizer operated at 5000 psi and then heated to 60° C. with 100 rpm stirring overnight.

The average particle size as measured by a Coulter Multisizer TAII is reported as the volume mean, by which is meant the equivalent spherical diameter calculated from the volume average distribution. Also measured are the number of oversized particles defined as those particles larger than 5 micrometers reported as parts per million (ppm). Particles greater than 8 micrometers are also reported for reference. Results are presented in the following Tables 1 and 2 .

TABLE 1

| | Size (um) | ppm > 5 μm | ppm > 8 μm | Vinyl Toluene % | Stearyl Methacrylate % |
|---|---|---|---|---|---|
| Example 1 (comparison) | 2.47 | 3,208 | 90 | 100 | 0 |
| Example 2 (invention) | 2.37 | 281 | 20 | 99 | 1 |
| Example 3 (invention) | 2.36 | 182 | 14 | 95 | 5 |

TABLE 2

| | Size (um) | ppm > 5 μm | ppm > 8 μm | Methyl Acrylate % | Stearyl Methacrylate % |
|---|---|---|---|---|---|
| Example 4 (comparison) | Agglomerated | NA | NA | 100 | 0 |
| Example 5 (invention) | 3.6 | 18,100 | 1,157 | 99 | 1 |
| Example 6 (invention) | 2.9 | 3,277 | 223 | 95 | 5 |

The data in Table 1 show that small amounts of stearyl methacrylate unexpectedly reduce the number of oversized particles. The data in Table 2 show that small amounts of stearyl methacrylate unexpectedly allow for succesful formation of methylacrylate polymer particles which otherwise because of its hydrophilic nature agglomerates during polymerization.

EXAMPLE 7

A photographic element is prepared as follows: A poly (ethylene naphthalate) support having an antihalation layer on one side and an antistatic layer overcoated with a transparent magnetic recording layer on the other side is coated on the antihalation layer with the following imaging forming layers in sequence.

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 μm grain size) (0.387 g/m$^2$silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer: This layer comprises a blend of a red sensitive silver bromoiodide emulsion (3.3 mole percent iodide) (0.488 μm grain size) (0.816 g/m$^2$ silver) and a red sensitive, tabular grain, silver bromoiodide emulsion (4.5 mole percent iodide). (0.98 μm diameter by 0.11 μm thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 μm diameter by 0.11 μm thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$ ) .

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer: This layer comprises a blend of a green sensitive, tabular grain, silver bromoiodide emulsion (1.5 mole percent iodide) (0.7 μm diameter by 0.112 μm thick) (0.258 g/m$^2$ Ag), and a green sensitive, tabular grain, silver bromoiodide emulsion (1.3 mole percent iodide) (0.54 μm diameter by 0.086 μm thick) (0.409 g/m$^2$ Ag), compound M-1 (0.204 g/m$^2$), ME-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 μm diameter by 0.12 μm thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive, tabular grain, silver bromoiodide emulsion (4.5 mole percent iodide) (0.98 μm diameter by 0.113 μm thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer: This layer comprises 2,5-di-t-octyl-1, 4-dihydroxy benzene (0.075 g/m$^2$), YD-2 (0.108 g/m$^2$), Irganox 1076 sold by Ciba Geigy (0.01g/m$^2$), S-2 (0.121 g/m$^2$) and gelatin (0.861 g/m$^2$).

Slow Yellow Dye-forming Layer: This layer comprises a blend of a blue sensitive, tabular grain, silver bromoiodide emulsion (4.5 mole percent iodide) (1.4 μm diameter by 0.131 μm thick) (0.161 g/m$^2$ Ag), a blue sensitive, tabular grain, silver bromoiodide emulsion (1.5 mole percent iodide) (0.85 μm diameter by 0.131 μm thick) (0.0.108 g/m$^2$ Ag), and a blue sensitive, tabular grain, silver bromoiodide emulsion (1.3 mole percent iodide) (0.54 μm diameter by 0.086 μm thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer: This layer comprises a blue sensitive, tabular grain, silver bromoiodide emulsion (4.5 mole percent iodide) (2.3 μm diameter by 0.128 μm thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

UV Protective Layer: This layer comprises compound UV-1 (0.111 g/m$^2$), UV-2 (0.111 g/m$^2$)S-4 (0.222 g/m$^2$), silver bromide Lippmann emulsion (0.215 g/m$^2$ Ag), and gelatin (0.7 g/m$^2$).

Overcoat Layer: This layer comprises matte particles of Example 2 (0.038) and gelatin (0.888).

This photographic film is perforated in 35 mm format, exposed in a 35 mm camera and processed in a standard photofinishing processor and printed.

The structures of the above-designated compounds are as follows:

Y1

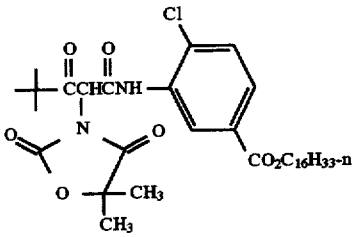

IR-1

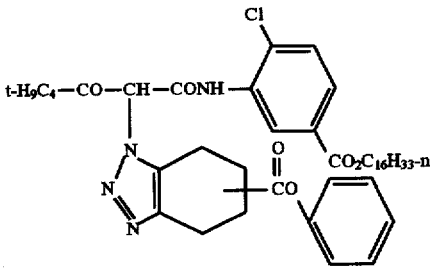

YD-2

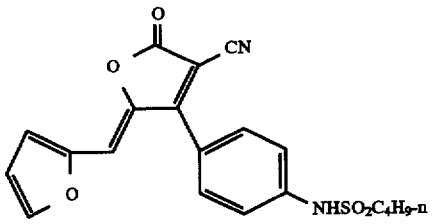

ST-1

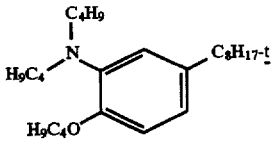

IR-2

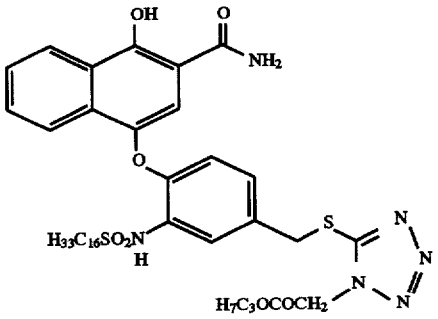

IR-3

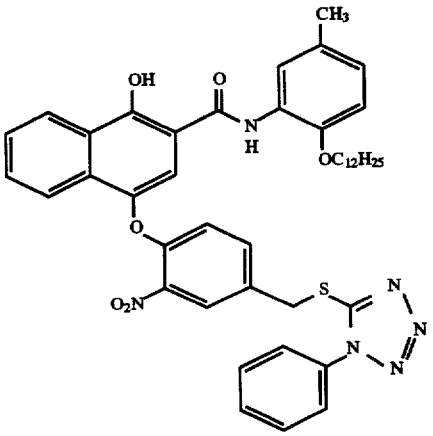

IR-4

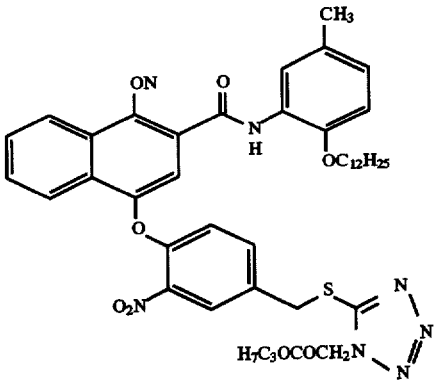

B-1

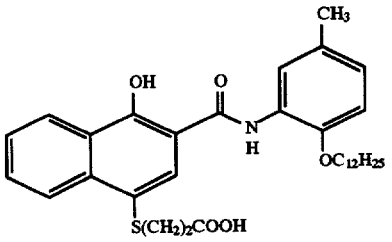

-continued
M-1
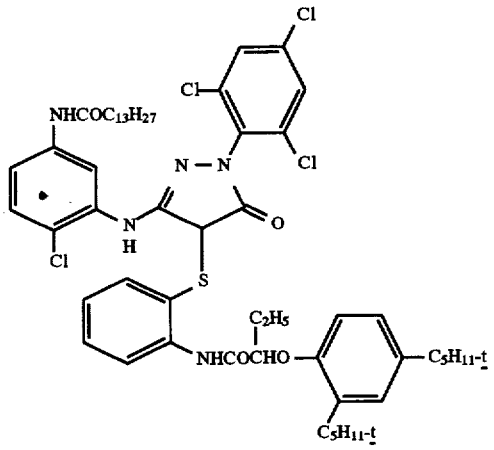
MM-1
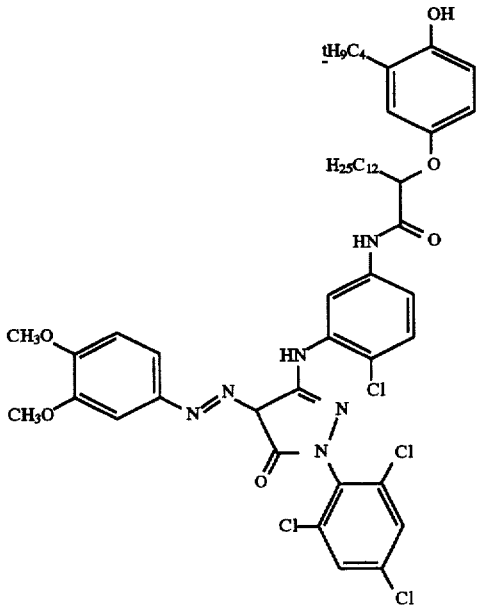
CC-1
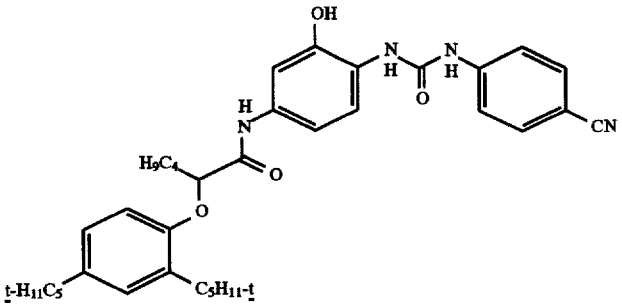
CM-1
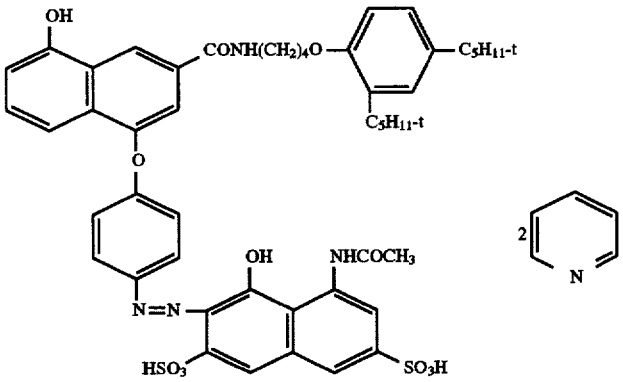
S-1
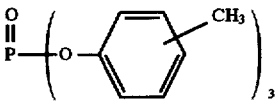
S-2
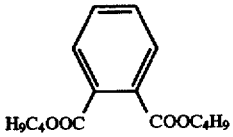

-continued $C_{11}H_{23}CON(C_2H_5)_2$ S-3

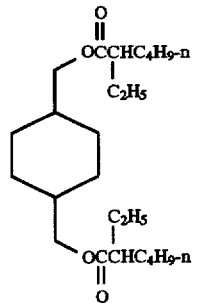

S-4

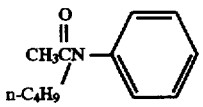

S-5

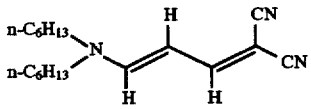

UV-1

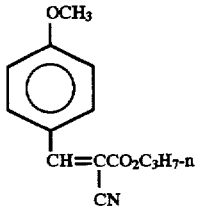

UV-2

This photographic film is found under visual inspection to be free of defects due to the presence of oversized matte particles.

What is claimed is:

1. A photographic element having a support, at least one light-sensitive silver halide layer and a layer containing matte bead particles, the matte bead particles being a copolymer of a styrenic monomer or acrylic acid or methacrylic acid or an acrylic acid ester or a methacrylic acid ester or mixture thereof where the ester group contains up to 6 carbon atoms and an acrylic or methacrylic acid ester where the ester group has from 10 to 22 carbon atoms in an amount of from 0.1 to 20 percent by weight of the copolymer, each matte bead particle being surrounded by colloidal size particles of a suspension stabilizing agent.

2. The photographic element of claim 1 wherein the methacrylic acid ester having from 10 to 22 carbon atoms is lauryl methacrylate.

3. The photographic element of claim 1 wherein the methacrylic acid ester having from 10 to 22 carbon atoms is stearyl methacrylate.

4. The photographic element of claim 1 wherein the matte bead particles have a mean particle size of from 0.3 to 10 μm.

5. The photographic element of claim 1 wherein the suspension stabilizing agent is colloidal silica.

6. The photographic element of claim 1 wherein the acrylic or methacrylic acid ester having 10 to 22 carbon atoms is present in an amount of 0.5 to 10 percent by weight of the copolymer.

7. The photographic element of claim 1 wherein the acrylic or methacrylic acid ester having 10 to 22 carbon atoms is present in an amount of 1 to 5 percent by weight of the copolymer.

* * * * *